US006719485B1

(12) United States Patent
Roth

(10) Patent No.: US 6,719,485 B1
(45) Date of Patent: Apr. 13, 2004

(54) COMPACTION ROLLER AND METHOD FOR RUBBLIZING CONRETE

(76) Inventor: Scott R. Roth, 848 Hidden Hills Dr., Bellevue, NE (US) 68005

( * ) Notice: Subject to any disclaimer, the term of this patent is extended or adjusted under 35 U.S.C. 154(b) by 0 days.

(21) Appl. No.: 10/212,305

(22) Filed: Aug. 5, 2002

(51) Int. Cl.[7] ..... E21C 25/00

(52) U.S. Cl. ..... 404/75; 404/93; 404/94; 404/124; 299/39.4; 299/39.8; 299/40.1

(58) Field of Search ..... 299/39.4, 39.8, 299/40.1; 404/93, 94, 75, 124, 128

(56) References Cited

U.S. PATENT DOCUMENTS

| | | | | |
|---|---|---|---|---|
| 3,950,110 A | | 4/1976 | Clifford | |
| 3,966,346 A | | 6/1976 | Berrange | |
| 4,147,448 A | | 4/1979 | Jeffery | |
| 4,334,799 A | * | 6/1982 | Rautenbach et al. | 404/124 |
| 4,422,795 A | * | 12/1983 | Berrange | 404/124 |
| 4,573,826 A | | 3/1986 | Piovesan | |
| 5,462,387 A | | 10/1995 | Roth | |
| 6,004,076 A | * | 12/1999 | Cook et al. | 405/271 |
| 6,065,904 A | * | 5/2000 | Cook et al. | 405/303 |
| 6,485,227 B1 | * | 11/2002 | Mathiowetz | 404/90 |

* cited by examiner

*Primary Examiner*—Gary S. Hartmann

(57) ABSTRACT

A concrete rubblizing apparatus includes a non-circular multi-lobed roller connected to an axle on a wheeled frame such that the roller rolls upon the ground and the frame is towed by a tractor. Each lobe of the roller includes a set of cleats extending across a width of the roller and projecting outwardly from the impact surface of each lobe along a line parallel to the axle. The method of rubblizing includes moving the roller over a predetermined area of concrete along four, sequential overlapping paths.

3 Claims, 4 Drawing Sheets

COMPACTION ROLLER AND METHOD FOR RUBBLIZING CONRETE

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to a method for crushing poured concrete roadways into rubble (hereinafter "rubblizing") using a compaction roller, and more particularly to an improved method for rubblizing concrete using a roller designed to compact broken ground, rubblized surfaces and gravel roads and the like.

(2) Background Information

In the repair and reconstruction of streets and highways, it is typically necessary to remove the existing concrete and prepare the underlying surface for new concrete. The process for breaking hardened concrete is conventionally quite time-consuming, thereby slowing down the entire reconstruction project.

Prior art apparatus for breaking concrete includes large, high-density balls which are dropped on the concrete to break it into small pieces. In addition, "guillotines" have been utilized, which have a heavy weight with a sharpened lower edge that is driven downwardly by gravity to drive a wedge into the concrete. When a guillotine is used, the wedge must typically be dropped a number of times in order to cause the splitting and breaking-apart of the concrete. Other methods available for breaking concrete include the use of jack hammers and the like. Again, such apparatus and methods are typically very slow.

In response to these problems, the inventor herein created a new device, which is the subject of U.S. Pat. No. 5,462,387, entitled "Concrete Breaking Apparatus."

That invention is very successful in cracking and breaking the concrete of streets and roadways, to permit removal of the surface material. However, the inventor has found that there are situations where the broken concrete could be left in place to serve as a support bed, if the concrete could be broken into sufficiently small pieces of rubble. This, in turn, would dramatically reduce the time and expense that would otherwise be required to remove the concrete and install a gravel or similar particulate support bed.

In addition, the compaction roller used in such a method would need to be modified in order to assure that the roller would roll over particulate material, and not merely slide across the surface.

BRIEF SUMMARY OF THE INVENTION

It is therefore a general object of the present invention to provide an improved method for crushing concrete roadbed into rubble.

Another object of the present invention is to provide an apparatus for the rubblizing method of the invention.

A further object is to provide a method for rubblizing concrete using a compaction roller.

Still another object of the present invention is to provide an improved compaction roller with a surface that will grip particulate and similar rough and particulate ground surfaces.

These and other objects of the present invention will be apparent to those skilled in the art.

The concrete rubblizing apparatus of the present invention includes a non-circular multi-lobed roller connected to an axle on a wheeled frame such that the roller rolls upon the ground and the frame is towed by a tractor. Each lobe of the roller includes a set of cleats extending across a width of the roller and projecting outwardly from the impact surface of each lobe along a line parallel to the axle. The method of rubblizing includes moving the roller over a predetermined area of concrete along four, sequential overlapping paths.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
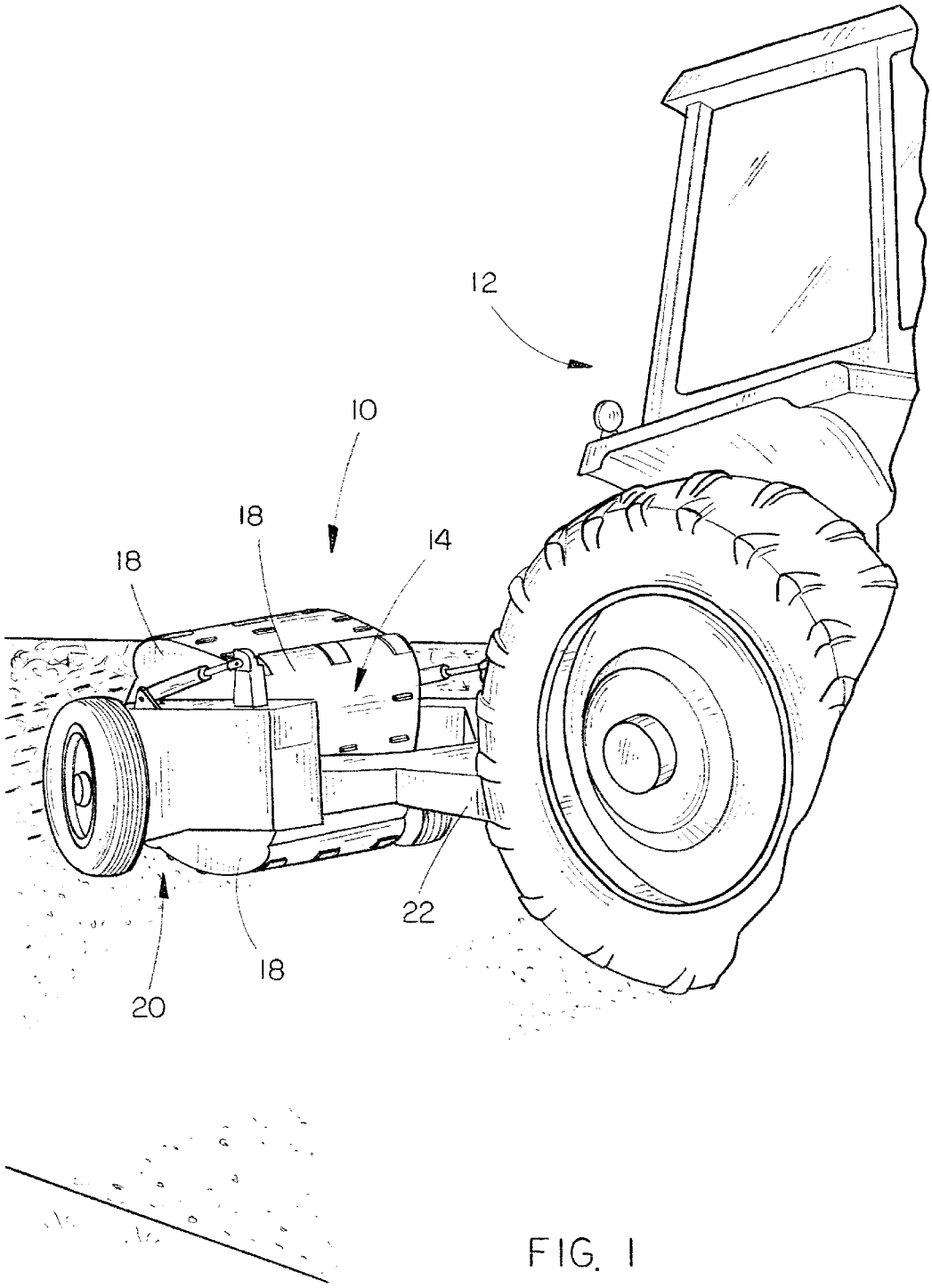
FIG. 1 is a pictorial view of the invention towed behind a tractor.

Referring now to the drawings, in which similar or corresponding parts are identified with the same reference numeral, and more particularly to FIG. 1, the concrete rubblizing apparatus of the present invention is designated generally at 10 and is shown being towed behind a tractor 12.

Rubblizing apparatus 10 is essentially a modification to the concrete breaking apparatus described in U.S. Pat. No. 5,462,387 to Scott Roth. The apparatus includes multi-lobed non-circular impact roller 14 having a rotational axis 16 (shown in FIG. 2) and four lobes 18. Roller. 14 is mounted rotatably on a wheeled frame 20, with a forwardly projecting tongue 22 that may be connected to a tractor 12, or other tow vehicle.

Figure 2:
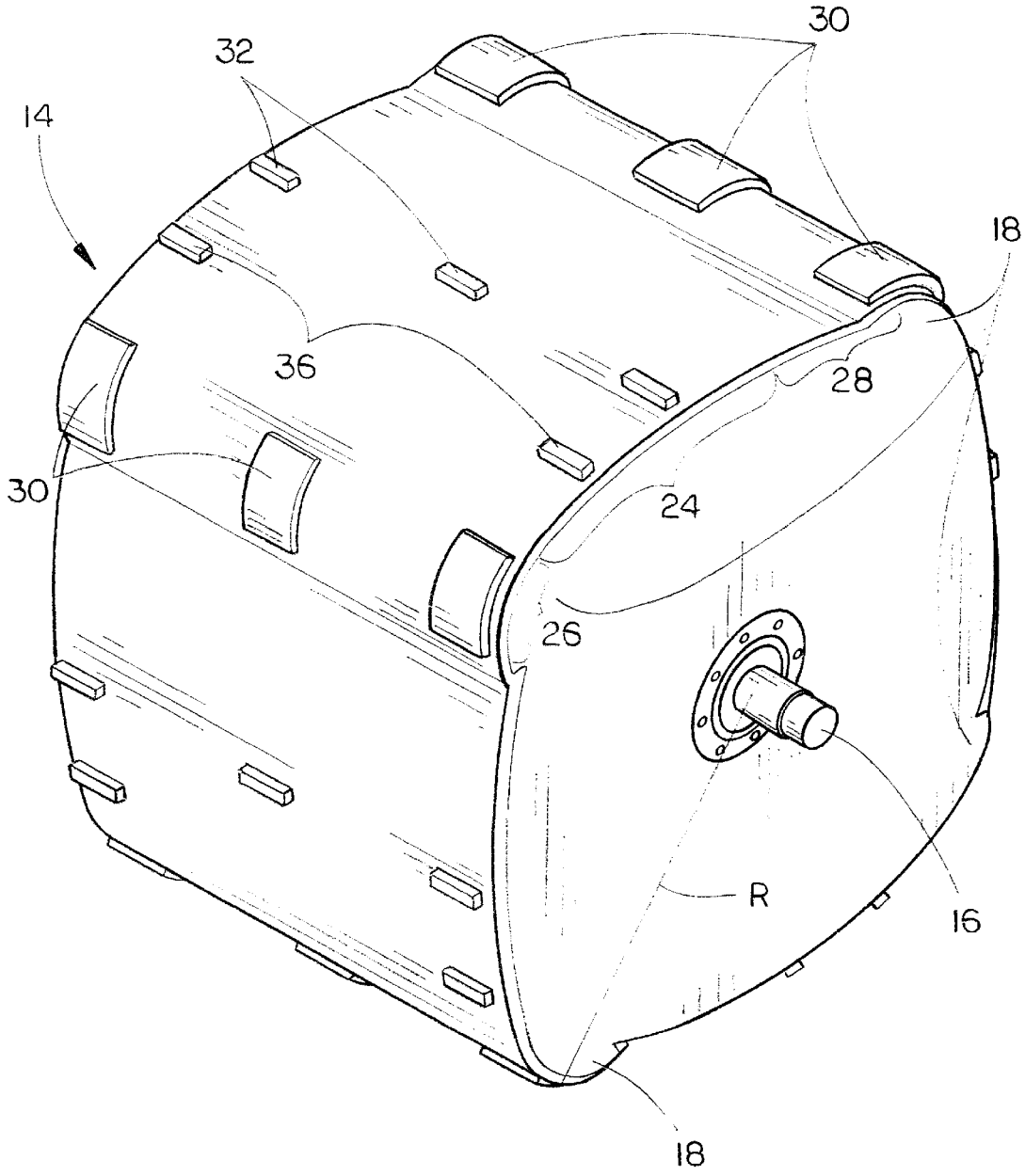
FIG. 2 is an enlarged perspective view of the roller of the invention.

Referring now to FIG. 2, roller 14 is shown in more detail, including four lobes 18 spaced at 90° from one another relative to axis 16, and having a maximum radius R. Each side or lobe 18 may be divided into three surfaces, an impact surface 24, a pivot surface 26, and a "dead" area 28. The impact surface is slightly curved, along a large radius, and thus is generally flat in character. The pivot surfaces 26 are curved to a short radius, and serve as a fulcrum as the following lobe 18 swings overhead and thence towards the ground. A plurality of wear plates 30 are mounted along each pivot surface 26, and serve to raise the lobe slightly higher as the roller rotates, thereby increasing the striking force of each lobe 18. In addition, the wear plates 30 serve as the pivoting contact surface on the ground, where the "wear" on the roller occurs. These wear plates may be replaced as necessary, once the plates 30 have been worn down to the pivot surface 26 of the roller 14.

The original use of a roller 14 was for the compaction of soil, by rolling the roller 14 along the ground. Roller 14 weighs about 30,000 pounds, and is preferably rolled at a speed of 7–9 miles per hour, causing two lobes of the roller to strike the ground each second. Each lobe 18 causes the rotational axis 16 to rise relative to the ground, thereby causing a larger dynamic impact force along the impact surface 24 of each lobe 18. It is estimated that the impact force along the entire impact surface is approximately 22,000 foot pounds when the compaction roller is moved at the above described velocity.

While the conventional compaction roller was quite effective in compacting soil, the inventor discovered that the addition of a projecting ridge located in the center of the impact surface 24 of the roller 14 would provide a dynamic force capable of breaking concrete up to 12 inches thick. The original ridge has been replaced by a series of projecting cleats 32 extending transversely across the width of the roller 14, as shown in FIG. 2.

Figure 3:
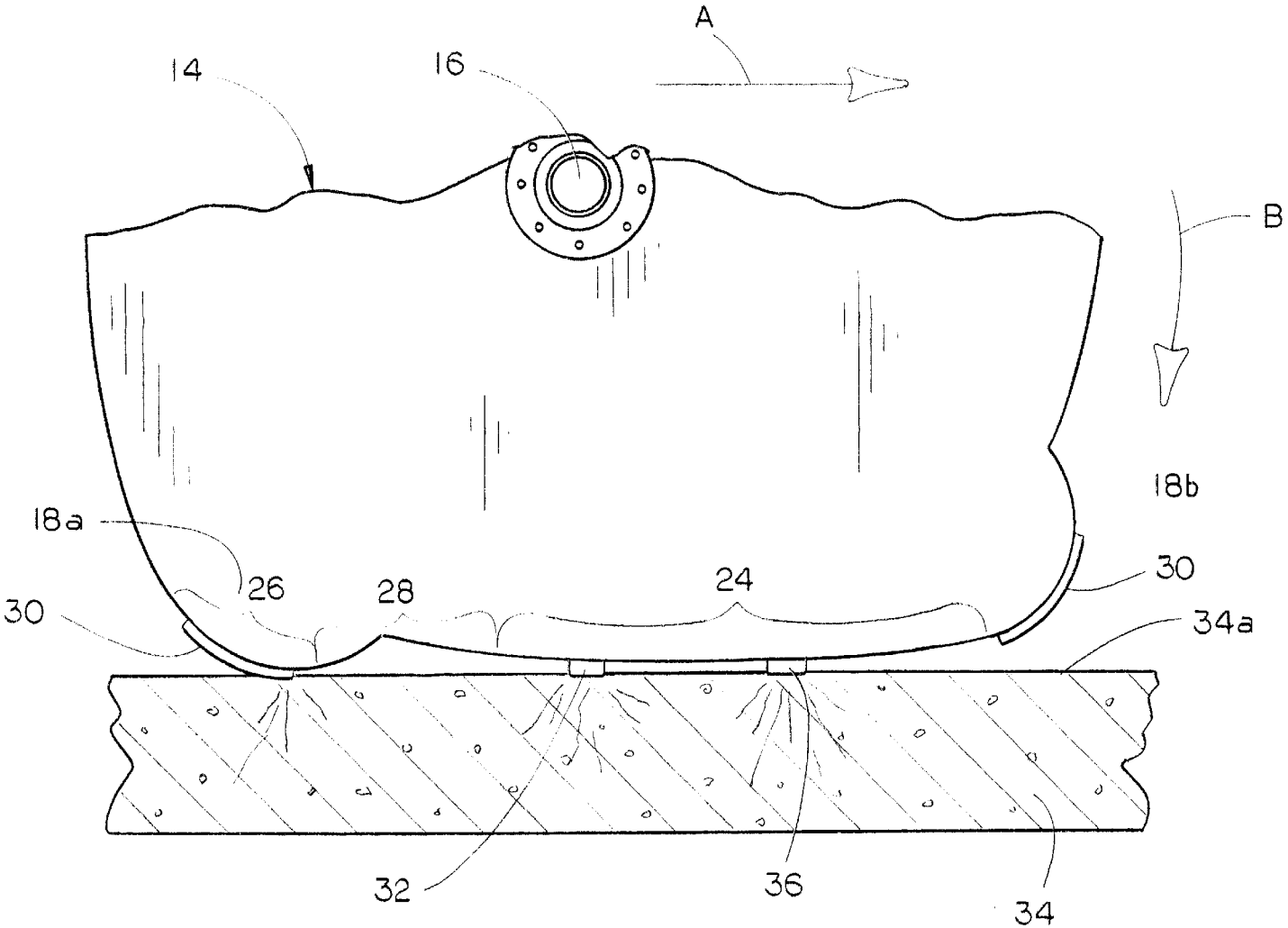
FIG. 3 is an enlarged sectional view of the roller contacting a section of concrete.

Referring now to FIG. 3, roller 14 is shown as it rolls to the right in the drawing, from lobe 18*a* to lobe 18*b*. Cleats 32 are rectangular bars welded to the impact surface 24 and oriented parallel to the rotational axis 16 of roller 14. As shown in FIG. 3, cleats 32 are located generally centrally on the impact surface, such that cleats 32 are the first members of the roller 14 to contact the upper surface 34a of concrete roadway 34. As roller 14 continues to turn, as indicated by arrow B, and the downward force of lobe 18*b*continues, the remaining "flat" surface of impact surface 24 will then impact upon concrete roadway upper surface 34*a*. Thus, cleats 32 will "sink in" to the concrete 34 as the roller 14 continues forward, as indicated by arrow A. Because of the dynamic force applied along cleats 32 and impact surface 24, it has been found that concrete up to 12 inches thick will be caused to crack.

Although the original concrete breaking apparatus works well to crack concrete on the initial pass, it has been found that the roller can be used to crush the concrete into rubble if it is operated in a particular method, as described in more detail below.

Figure 4:
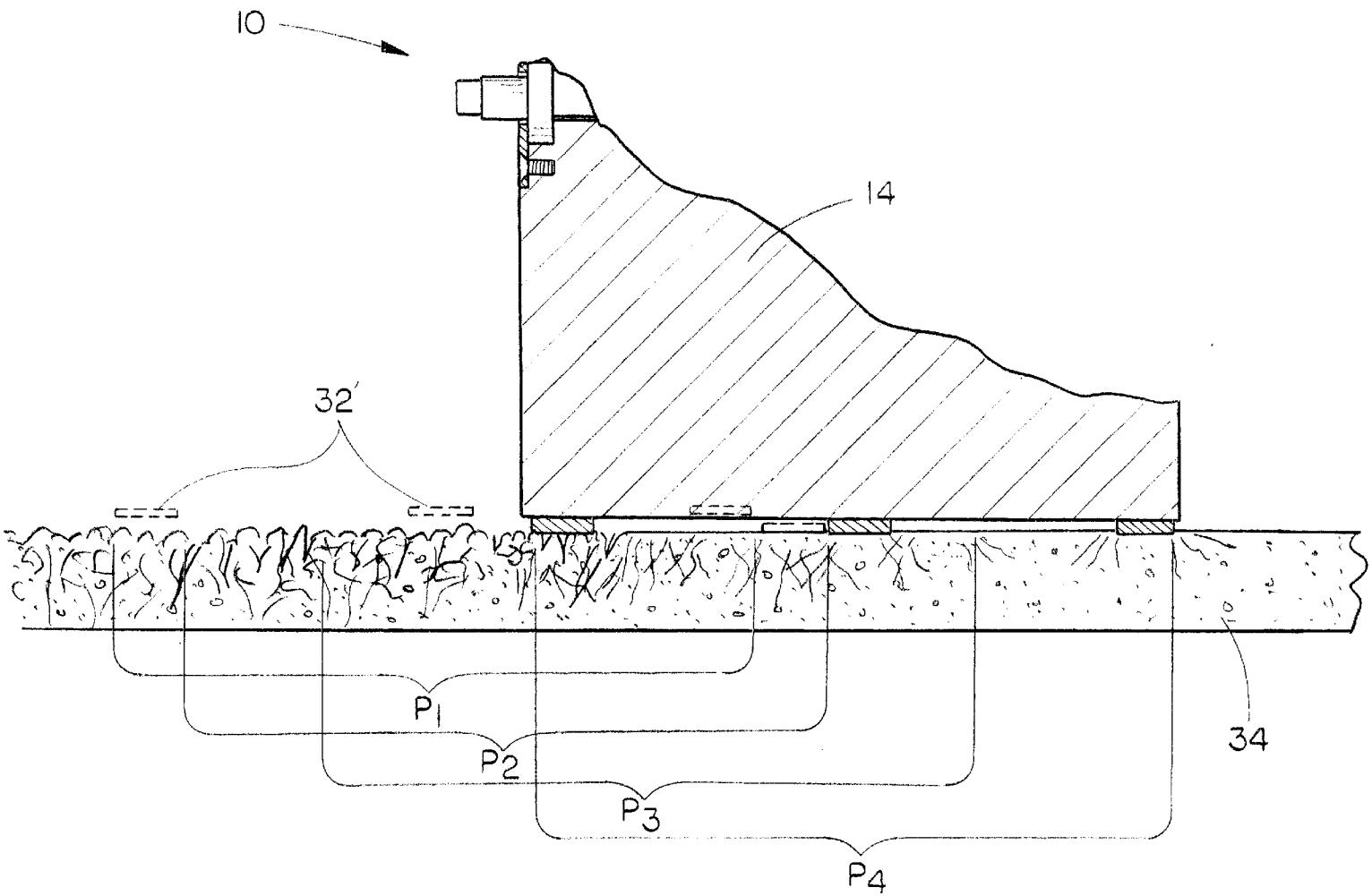
FIG. 4 is an end view of the roller and a sectional view through a section of concrete showing the method of the present invention.

Referring now to FIG. 4, rubblizing apparatus 10 is shown after four sequential passes over concrete roadway 34. Each pass is identified as $P_1$, $P_2$, $P_3$, and $P_4$, respectively. The approximate position of the cleats 32 in the initial pass $P_1$, is shown by cleats 32' in hidden lines in FIG. 4. In the second pass $P_2$, the roller 14 is shifted to the side approximately one-fourth the width of the roller 14. Passes $P_3$ and $P_4$ are also shifted by about one-fourth the width of the roller 14. In this way, every part of roadway 34 is impacted four times in sequence. This has been found to crush the concrete of the roadway 34 into small, uniform size rubble, which may then be used for a bed to support concrete or other roadway surface.

As the roadway 34 is rubblized according to the method of this invention, it was found that the roller 14 would frequently slide on the rubble surface, rather than roll. The same thing was found to occur along other types of road surfaces such as sand or gravel roads, as the road was attempted to be compacted. To overcome this problem, a series of gripping cleats 36 were added to each lobe of the roller 14, as shown in FIGS. 2 and 3. Cleats 36 are also generally rectangular in shape, and located generally centrally between the cleats 32 and the forwardly adjacent pivot surface 26 of the next lobe 18*b*. Thus, the first set of cleats 32 contact and break the roadway surface first, then the remaining flat surface of the impact surface 26, and the gripping cleats 36 will contact the roadway surface. This additional set of cleats 36 has been found sufficient to prevent the roller 14 from sliding along the surface of the roadway 34, while assisting in the crushing and rubblizing of the concrete roadway surface.

These additional gripping cleats 36 permit use of the rubblizing apparatus 10 of the present invention in a new way, to compact road surfaces of sand, dirt or gravel. This is typically necessary as a step in refurbishing county roads. Without the cleats 32 and 36 of the present invention, the roller 14 could not be used for such a task, because the roller 14 would simply slide along the road rather than rolling and compacting the surface.

Whereas the invention has been shown and described in connection with the preferred embodiment thereof, many modifications, substitutions and additions may be made which are within the intended broad scope of the appended claims.

What is claimed is:

1. A concrete roadway rubblizing apparatus, comprising:

a non-circular multi-lobed roller rotatably mounted on an axle, the axle mounted on a frame to follow the frame as the frame moves along the ground;

each lobe of the roller including an impact surface that intermittently contacts the ground as the roller rotates on the axle;

a first set of projecting cleats on each impact surface, arranged parallel to the axle and generally centrally within the impact surface, between a pair of lobes, and located to impact the roadway prior to any other portion of the impact surface as the roller moves along the roadway; and a second set of projecting cleats on each impact surface, arranged parallel to the first set and generally centrally between each first set of cleats and the next adjacent lobe which will next contact the ground, said second set of cleats located to contact and grip the roadway surface subsequent to the impact of the first set of cleats.

2. The apparatus of claim 1, wherein each lobe includes a pivoting surface that will contact the ground and act as a fulcrum as the roller rotates on the axle, and further comprising a plurality of spaced apart wear plates projecting from each pivoting surface of each lobe.

3. A method for rubblizing a concrete surface of a roadway, comprising the steps of:

providing a multi-lobed non-circular compaction roller with a first set of cleats arranged transversely across a width of the roller and located generally centrally on an impact surface of each lobe, the roller of the type rotatably mounted on an axle connected to a frame;

providing said roller with a second set of cleats arranged parallel to the first set of cleats and located generally centrally between each first set of cleats and the next adjacent lobe which will next contact the ground, said second set of cleats located to contact and grip the roadway surface subsequent to the impact of the first set of cleats;

moving the frame and roller over a predetermined area of concrete to form a first pass, such that the first set of cleats impact upon the concrete as the roller rotates on its axle to crack and break the concrete;

moving the frame and roller over a predetermined area of concrete to form a second pass, with the second pass overlapping about three-fourths of the first pass, such that the first set of cleats impact upon the cracked and broken concrete to further break the concrete, and such that the second set of cleats sink into the broken roadway surface to grip the surface and keep the roller rotating;

moving the frame and roller over a predetermined area of concrete to form a third pass, with the third pass overlapping about three fourths of the second pass and about one-half the first pass, such that the first set of cleats impact upon the cracked and broken concrete to further break the concrete, and such that the second set of cleats sink into the broken roadway surface to grip the surface and keep the roller rotating; and moving the frame and roller over a predetermined area of concrete to form a fourth pass, with the fourth pass overlapping about three-fourths of the third pass, one-half the second pass, and one-fourth of the first pass, such that the first set of cleats impact upon the cracked and broken concrete to further break the concrete, and such that the second set of cleats sink into the broken roadway surface to grip the surface and keep the roller rotating;

whereby the second set of cleats grips the broken roadway surface to maintain the roller rotating and the first set of cleats repeatedly breaks the roadway surface such that the concrete roadway is rubblized to uniform size small pieces by four sequential passes of a portion of the roller.

* * * * *